US006718990B1

(12) United States Patent
Chastain et al.

(10) Patent No.: US 6,718,990 B1
(45) Date of Patent: Apr. 13, 2004

(54) COSMETICS CONTAINER AND APPLICATOR FOR ONE HAND OPERATION

(75) Inventors: David P. Chastain, Acton, MA (US); Gauray Rohatgi, Franklin, MA (US); Kevin Robert Young, S. Boston, MA (US); Thorben Neu, Los Angeles, CA (US); Stephanie Schwarz, New York, NY (US)

(73) Assignee: The Bridgeport Metal Goods Manufacturing Company, Stratford, CT (US)

( * ) Notice: Subject to any disclaimer, the term of this patent is extended or adjusted under 35 U.S.C. 154(b) by 719 days.

(21) Appl. No.: 09/647,646

(22) PCT Filed: Jul. 28, 2000

(86) PCT No.: PCT/US00/20454

§ 371 (c)(1),
(2), (4) Date: Feb. 24, 2003

(87) PCT Pub. No.: WO01/08530

PCT Pub. Date: Feb. 8, 2001

Related U.S. Application Data

(60) Provisional application No. 60/146,269, filed on Jul. 29, 1999, and provisional application No. 60/154,048, filed on Sep. 16, 1999.

(51) Int. Cl.[7] ..... A45D 40/26; A45D 40/24; B43K 5/16

(52) U.S. Cl. ..... 132/218; 132/317; 401/99

(58) Field of Search ..... 132/218, 317, 132/318, 320; 401/99, 115, 117, 122, 127; 15/184, 185

(56) References Cited

U.S. PATENT DOCUMENTS

| | | | | |
|---|---|---|---|---|
| 1,955,295 | A | 4/1934 | Hickox | 206/56 |
| 2,205,601 | A | 8/1938 | Satz et al. | 15/185 |
| 2,373,711 | A | 4/1945 | Satz et al. | 15/185 |
| 2,578,084 | A | 3/1946 | Mureau | 15/184 |

(List continued on next page.)

*Primary Examiner*—John J. Wilson
*Assistant Examiner*—Robyn Kieu Doan
(74) *Attorney, Agent, or Firm*—James R. Frederick; Ware, Fressola, Van Der Sluys & Adolphson LLP

(57) ABSTRACT

A cosmetics container (10) is adapted for one hand operation. The body (12) of the container (10) defines a reservoir (14) with cosmetics therein and further defines a passage (24) from the reservoir (14) and container (10). A resilient wiper (16) is mounted adjacent to the passage (24). A cosmetics applicator (18) is slidably supported within the reservoir (14) for movement from a loading position to a use position extending through the passage (24). A drive assembly including a knob (26) on the exterior of the container (10) adapted for one hand manipulation slides a drive belt (22) having one end connected to the applicator (18) in the reservoir (14) and the other end connected to a cover (23). Operation of the knob (26) in a first direction simultaneously withdraws the cover (23) and propels the applicator (18) from the reservoir (14). An umbrella pump (30) is mounted with the application (18) and lifts cosmetics to a loading zone adjacent the wiper (16), and carries cosmetics from the walls of the container (10) to a pump zone lower end of the container (10).

26 Claims, 16 Drawing Sheets

U.S. PATENT DOCUMENTS

| | | | | | |
|---|---|---|---|---|---|
| 2,582,451 | A | | 3/1946 | Mureau | 15/184 |
| 2,867,829 | A | | 1/1959 | Aversa | 15/133 |
| 3,035,299 | A | | 5/1962 | Gordon et al. | 15/537 |
| 3,612,072 | A | | 10/1971 | Fukui et al. | 132/88.7 |
| 3,945,734 | A | | 3/1976 | Woodbridge | 401/198 |
| 4,367,965 | A | | 1/1983 | Speitel et al. | 401/60 |
| 4,428,388 | A | | 1/1984 | Cassai et al. | 132/88.7 |
| 4,586,520 | A | | 5/1986 | Brittain | 132/88.7 |
| 4,598,723 | A | | 7/1986 | Cole | 132/88.7 |
| 4,609,300 | A | | 9/1986 | Robert | 401/122 |
| 4,617,948 | A | | 10/1986 | Gueret | 132/88.5 |
| 4,671,689 | A | | 6/1987 | Gueret | 401/122 |
| 4,687,364 | A | | 8/1987 | Kingsford | 401/127 |
| 4,810,122 | A | | 3/1989 | Cole | 401/122 |
| 5,054,946 | A | | 10/1991 | Morel | 401/122 |
| 5,061,103 | A | | 10/1991 | Walsh-Smith | 401/122 |
| 5,109,877 | A | | 5/1992 | Takeda | 132/218 |
| 5,131,774 | A | | 7/1992 | Katz | 401/99 |
| 5,339,841 | A | | 8/1994 | Gueret | 132/218 |
| 5,349,972 | A | | 9/1994 | Dirksing et al. | 132/218 |
| 5,951,185 | A | | 9/1999 | Kingsford et al. | 401/99 |
| 6,022,161 | A | * | 2/2000 | Choi | 401/99 |
| 6,026,825 | A | | 2/2000 | de Laforcade | 132/218 |

* cited by examiner

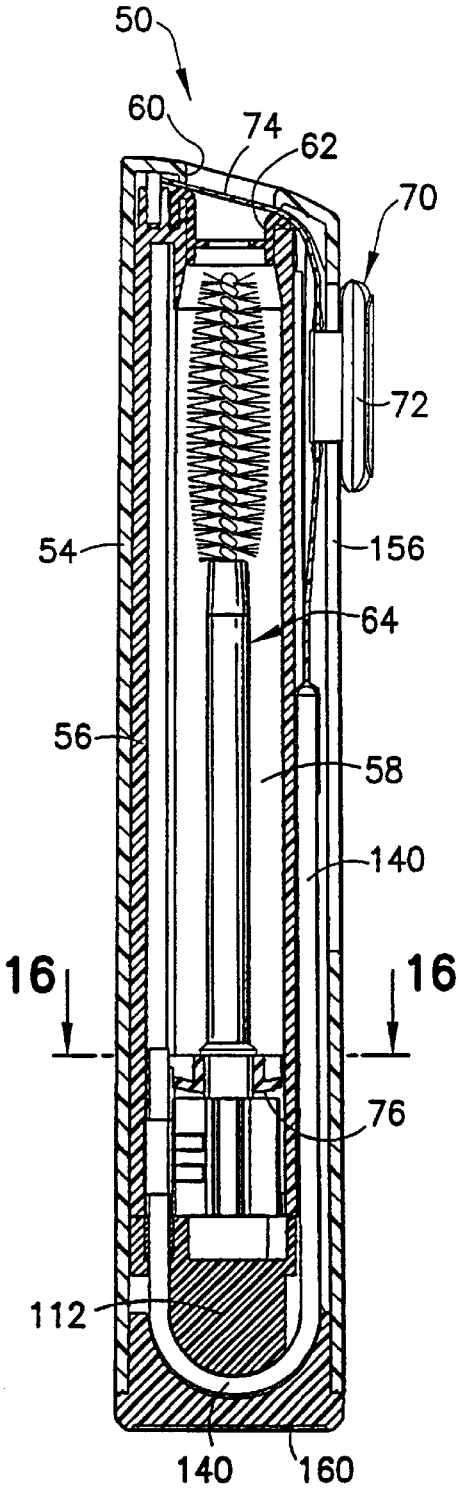
FIG.7
FIG.8
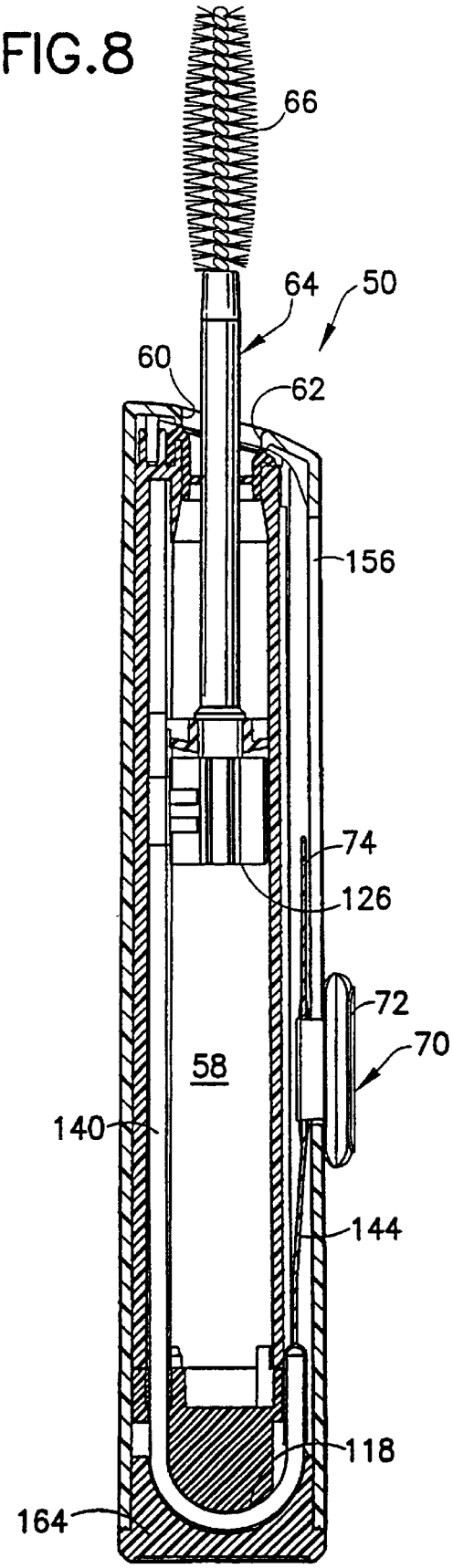

COSMETICS CONTAINER AND APPLICATOR FOR ONE HAND OPERATION

This application claims benefit of our U.S. Provisional Application 60/146,269 filed Jul. 29, 1999, our U.S. Provisional Application 60/154,048 filed Sep. 16, 1999 and our International Application PCT/US00/20454 filed Jul. 28, 2000.

FIELD OF THE INVENTION

The invention herein relates to a cosmetics container and applicator which can be operated with one hand.

BACKGROUND OF THE INVENTION

Prior art cosmetic containers often are two-piece assemblies. One body piece provides a reservoir for containing the liquid or pasty cosmetics, and the other piece includes a cap with an extending rod and applicator. The rod and applicator are inserted into the reservoir of the body containing the cosmetics and the cap is secured to the body for transportation and storage. The applicator also becomes loaded with cosmetics while in the reservoir, and the cap is removed to withdraw the applicator and then to apply the cosmetics.

If the user is conveniently seated at a makeup table, it is possible to put the container body on the table while the cosmetics applicator is being used. However, the user often holds the container body in one hand and the applicator in the other hand. This can be highly inconvenient, requiring a proverbial third hand, if the user also needs to hold a mirror or a purse or the like while applying the cosmetics.

The cosmetics applied with such containers is often mascara. However, the cosmetics also include other liquid, semi-liquid, pasty or related cosmetics such as lip gloss, concealer, eye shadow and other facial cosmetics.

There have been prior efforts to provide cosmetics containers for one handed operation. However, these efforts have generally not been successful. Some of the containers utilize a drive means which is axially aligned with the applicator rod and brush, resulting in a very long unit, whereas the dimensions of a cosmetics container for one hand operation should be close to those of a conventional one, both for ease of use and compact storage.

However, a major drawback to prior art one hand cosmetics container is their inability to adequately seal the cosmetics against leakage and drying. It is a necessity that the cosmetics be safely contained within a cosmetics container, so that no mess will result if the cosmetics container is carried in a purse. Also, if the cosmetics, and particularly mascara type cosmetics, are exposed to air through an inefficient seal, the cosmetics will not maintain the desired consistency but will instead dry out and become useless.

It is also necessary for a one handed cosmetics container to load the proper amount of cosmetics on the applicator, including any wiping aspects and avoidance of unwanted buildup of cosmetics at the point the applicator is returned to the container.

Accordingly, the art has not provided a satisfactory cosmetics container for one hand operation despite the obvious benefits such a container would achieve.

SUMMARY OF INVENTION

Accordingly, it is the principal object of the invention herein as to provide a cosmetics container for one hand operation.

It is an additional object of the invention herein to provide a cosmetics container for one hand operation which is of convenient shape and size.

It is a further object of the invention herein to provide a cosmetics container for one hand operation which seals the cosmetics against leakage and spoilage between uses.

It is an additional object of the invention herein to provide a mascara container for one hand operation which presents the applicator with a desired amount of cosmetics thereon for application.

It is a still further object of the invention herein to provide a cosmetics container for one hand operation which enhances the useful life of the cosmetics contained therein.

The invention herein relates to a cosmetics container, for facial cosmetics including mascara, that can be operated with one hand. According to broad aspects of the invention, an applicator is fully retracted within a reservoir defined by a cosmetics container body, with the body defining a passage for extending the applicator from the reservoir. A wiper is positioned at end of the body, having a wiper opening generally aligned with the passage. The cosmetics applicator including a rod is slidably supported within the reservoir for movement between a retracted loading position within the reservoir and a use position with the applicator extending through the passage. Drive means are mounted to the body, the drive means having a knob presented on the exterior of the body for one handed manipulation and a drive belt extending into the reservoir and connecting with the applicator. A cover is also connected with the drive means. Operation of the knob in a first direction removes the cover from sealing the passage and propels the applicator from the reservoir. Operating the knob in another direction retracts the applicator into the reservoir and closes the cover.

According to one aspect of the invention, the applicator is a mascara brush.

According to additional aspects of the invention, the knob, drive belt and cover are slidingly mounted on the body of the cosmetics container. The knob is mounted on a side of the elongated body, and one of the cover or drive belt are guided in a U-shaped path so that the drive belt and cover move in opposite directions relative to the passage. Thus, the cover moves away from the passage as the drive belt propels the applicator toward and through the passage.

According to further aspects of the invention, the wiper has a resilient rim and the cover, in its closed position, is supported against the resilient rim by the container body to provide a good seal. The resilient wiper is deformed to insure a good seal, and in more particular aspects the cover slides into its closed position and deformingly engages the rim of the wiper to achieve sealing relationship therewith, and the rim has a sealing bead to enhance the seal.

In accordance with other aspects of the invention, the container body includes an inner body defining the reservoir and mounting the wiper, and an outer body, with at least a portion of the cover positioned and guided between the inner body and outer body. The outer body is configured to guide the cover into sealing engagement with the wiper. According to more detailed aspects, the knob is presented on the exterior of the outer body and includes a stem extending through a slot in the outer body to connect with the cover and drive belt.

According to additional aspects of the invention, an umbrella pump is disposed within the reservoir and is driven upwardly and downwardly with the applicator. The umbrella pump positions, mixes and distributes the cosmetics within the body for fully loading the applicator and maintaining the cosmetics in good condition.

According to further aspects of the invention, the umbrella pump is carried toward the wiper with an outwardly propelled applicator rod to fill a loading space adjacent the wiper with cosmetics, and the umbrella pump flexibly deforms to release cosmetics in excess of the loading space volume. The excess cosmetics are deposited generally along the walls of the reservoir, below the loading space. As the applicator is retracted, the umbrella pump is carried downwardly in the reservoir and wipes the released cosmetics toward the bottom of the reservoir. As the umbrella pump approaches its lowest position, it flexibly deforms to release the wiped cosmetics and reposition them on the upper side of the umbrella pump, where the cosmetics are available in a pump space for carrying to the loading space on the next deployment of the applicator.

In accordance with additional aspects of the invention, the umbrella pump is partially supported on spaced-apart radial fins extending from the applicator rod. The radial fins extend to the walls of the inner body defining the reservoir, and also support the applicator for sliding motion within the reservoir.

Other aspects and features of the invention will in part appear from the following description of the preferred embodiments and claims, taken together with the drawings.

BRIEF DESCRIPTION OF THE DRAWINGS

FIG. 7 is a sectional view of the cosmetics container of FIG. 6 with its applicator in its retracted position;

FIG. 8 is a sectional view of the cosmetics container of FIG. 6, with the applicator in its extended use position;

The same reference numerals refer to the same elements throughout the various figures.

DETAILED DESCRIPTION OF THE INVENTION

Figure 1C:
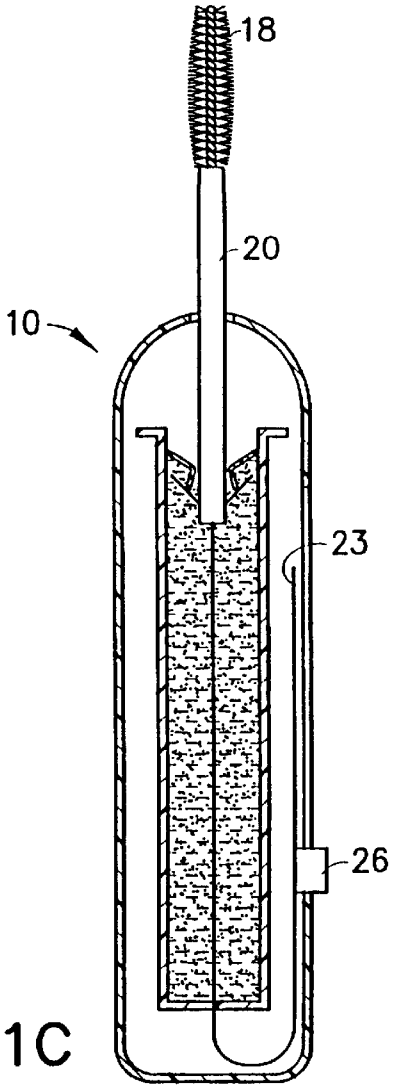
FIG. 1C is a schematic sectional view of the cosmetics container of FIG. 1A with the applicator fully deployed.
Figure 1B:
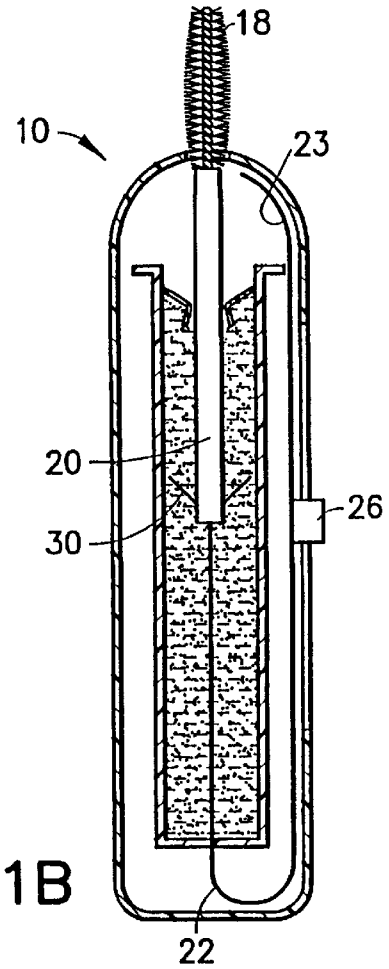
FIG. 1B is a schematic sectional view of the cosmetics container of FIG. 1A with the applicator partially deployed.
Figure 1A:
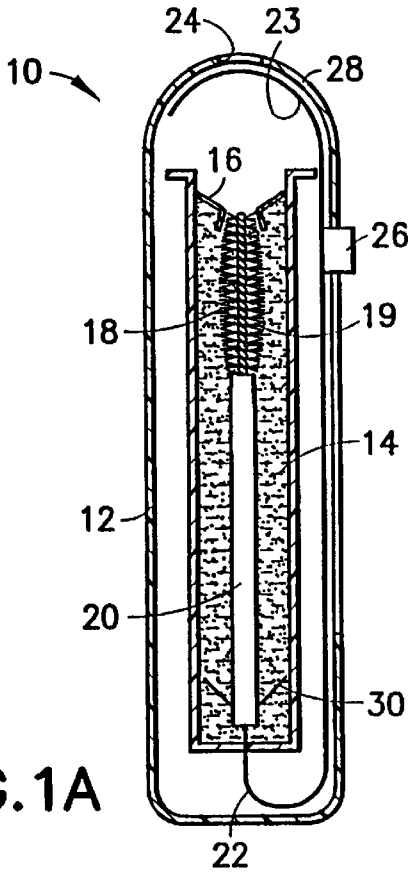
FIG. 1A is a schematic sectional view of a cosmetics container according to the invention and including an applicator in its closed position.
Figure 2:
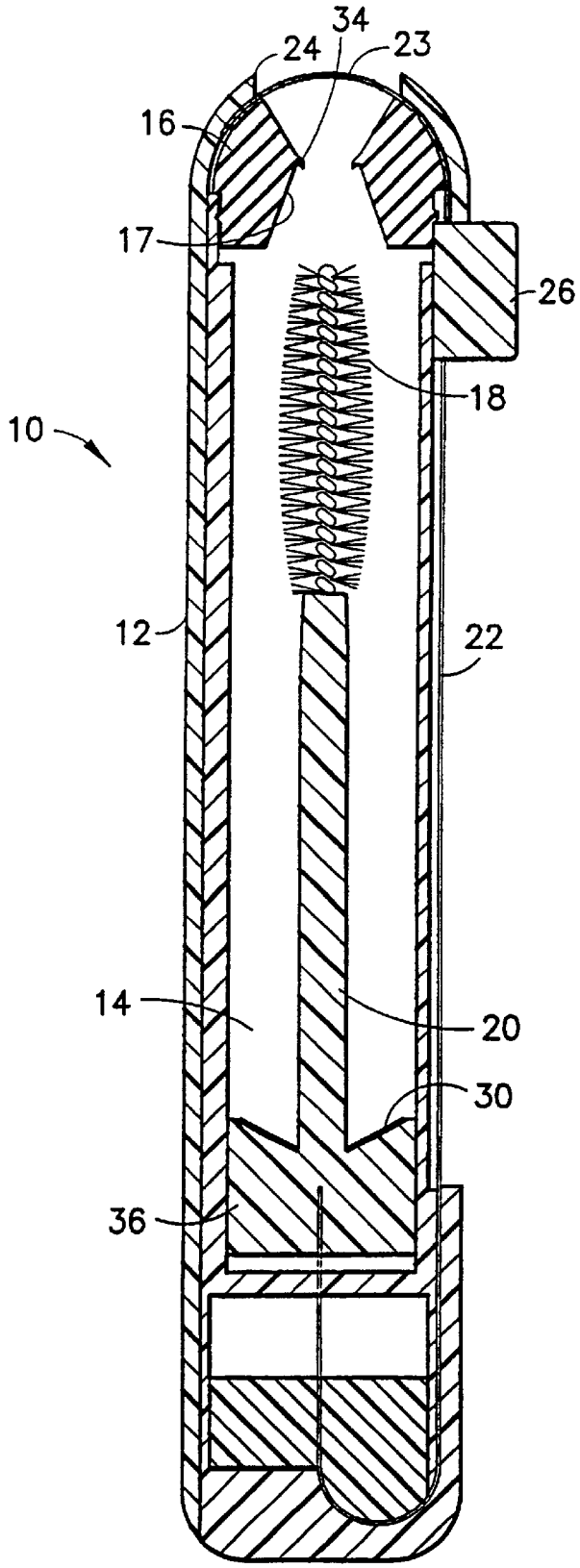
FIG. 2 is a sectional view of the cosmetics container of FIG. 1A, with more drive detail illustrated.
Figure 3:
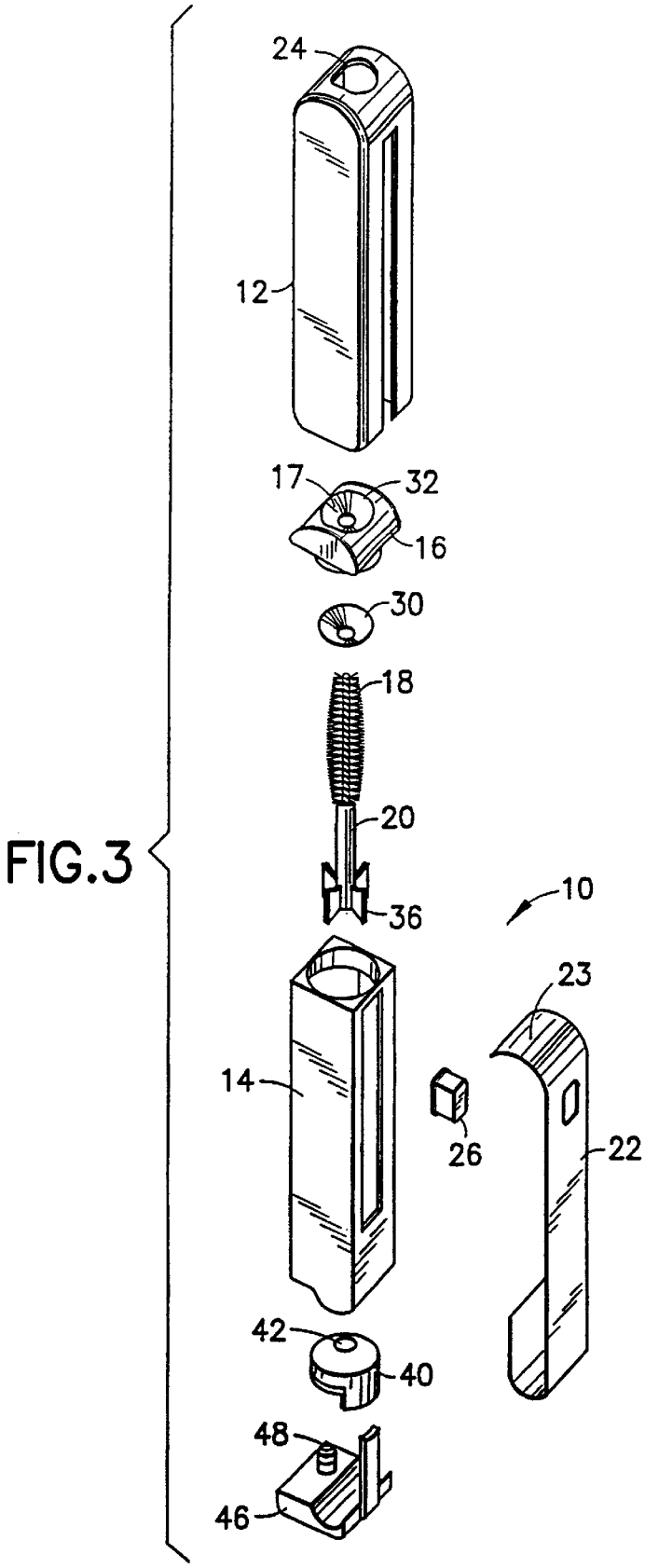
FIG. 3 is an exploded perspective view of the cosmetics container of FIG. 2.
Figure 6:
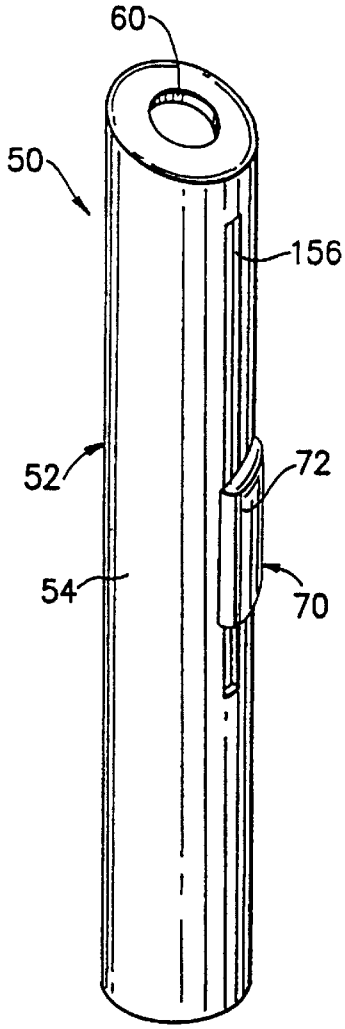
FIG. 6 is a perspective view of another cosmetics container according to the invention herein.

With reference to FIGS. 1A, 1B and 1C, a cosmetics container 10 is schematically shown which illustrates the invention herein. The cosmetics container 10 has a body 12 including a reservoir 14 filled with mascara. An exit passage 24 is defined at the end of the body. A combination wiper and seal 16 is provided at the outlet passage end of the container with its wiper opening generally aligned with the exit passage 24. The wiper 16 is shown schematically in FIGS. 1A, 1B and 1C, and is shown in more detail in FIGS. 2 and 4. An applicator including applicator brush 18 mounted on an applicator rod 20 is slidably mounted within the reservoir 14. A flexible drive belt 22 extends from the lower end of the applicator rod along the lower end and side of the body 12 and has a cover portion generally indicated at 23 covering the exit passage 24 at the upper end of the body 12. A knob 26, or alternatively a thumb wheel, is provided for driving the belt 22.

With reference to FIG. 1B, the knob 26 has been pulled downwardly, driving the applicator rod 20 and applicator brush 18 upwardly through the wiper 16 and the exit passage 24. It will be appreciated that as the drive belt 22 is driven to push up the applicator rod, it retracts the cover portion 23 from covering the exit passage 24 at the upper end of the body 12, providing clearance for the brush 18 to exit. This may be done by providing a slotted opening in the cover portion of the belt or by withdrawing it altogether. In FIG. 1C, the knob 26 is in its lowermost position and the applicator brush 18 is in its uppermost use position for application of mascara.

The applicator rod 20 has a flexible radially extending umbrella seal or pump 30 attached thereto. As the applicator moves up and down, the umbrella pump 30 mixes and distributes the mascara in the reservoir 14 body 12, positioning the mascara to fully load the mascara brush 19 when the mascara brush is withdrawn into the container. The mixing provided by the umbrella pump is also advantageous to maintaining the mascara product in good condition.

With reference to FIGS. 2–5, more detailed construction of the mascara container 10 is illustrated. The body 12 defines the upper exit passage 24, adjacent to which the wiper and seal component 16 is positioned. The wiper has wiper opening 17, generally aligned with the passage 24. The opening 17 through wiper 16 defines a wiper orifice 34 for removing excess mascara from the applicator brush 18.

Figure 4:
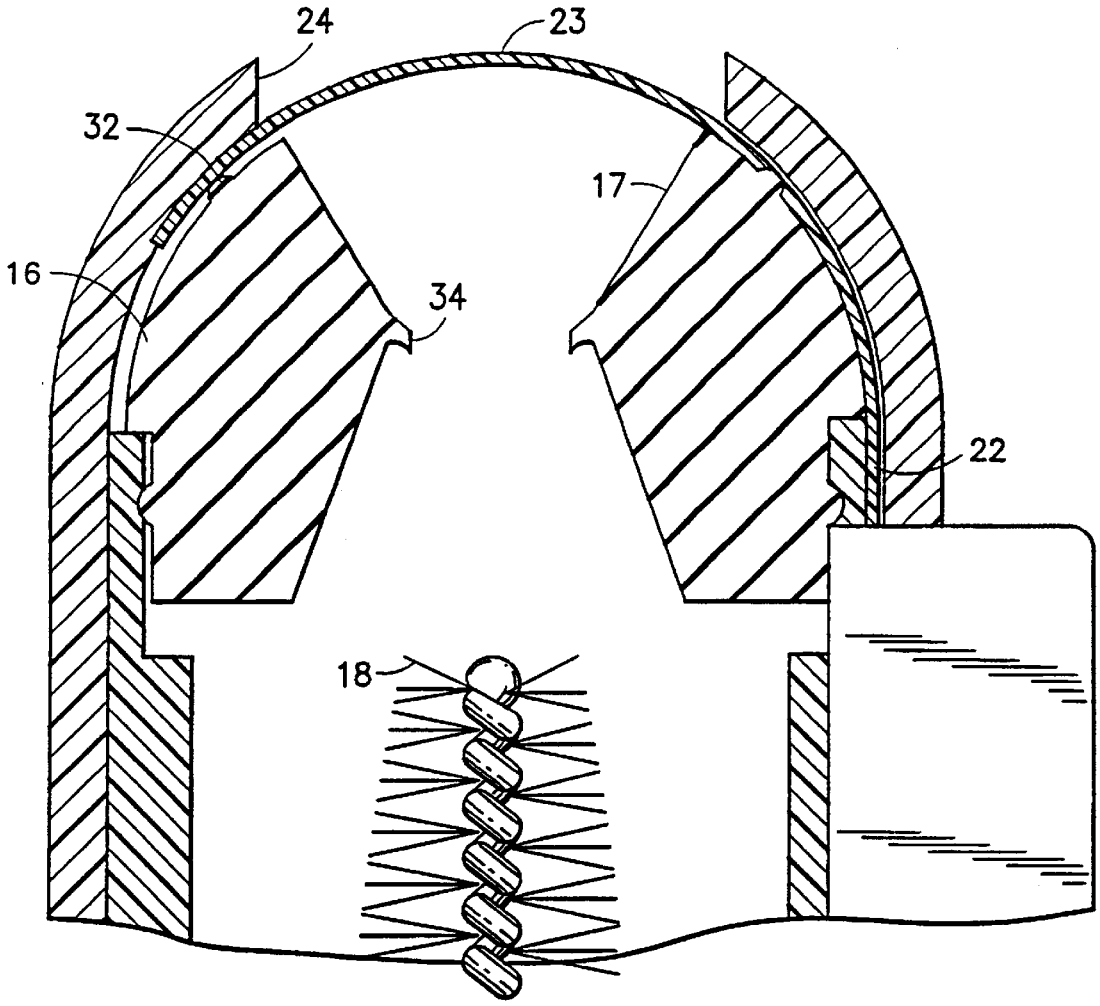
FIG. 4 is an enlarged view of the upper passage end of the cosmetics container of FIG. 2.

The cover portion 23 of drive belt 22 is shown extending across the exit passage 24, for sealing it. With reference to FIG. 4, the sealing aspect of the wiper 16 is shown in more detail, wherein the wiper 16 defines a peripheral sealing bead 32 which engages the underside of the cover portion 23 of drive belt 22 when the cover is closed. The sealing bead 32 surrounds the wiper opening 17.

The drive belt 22 is operated by the knob 26, and the drive belt is supported in a 180° U-turn at the lower end of the body 12 and is sealingly inserted into the reservoir 14 where it engages a radially finned slide base 36 of the applicator rod 20. The slide base 36 supports the umbrella pump 30 as the applicator rod 20 and brush 18 are extended upwardly in order to pump mascara toward the upper portion of the product cavity or reservoir 14. The umbrella pump flexes to bypass mascara when the upper portion of the reservoir is full. The periphery of the umbrella pump also lifts off the slide base 36 as the rod is pulled downwardly, leaving a trail of mascara along the walls of the product cavity for reloading the brush: This action also mixes and maintains the mascara.

Figure 5:
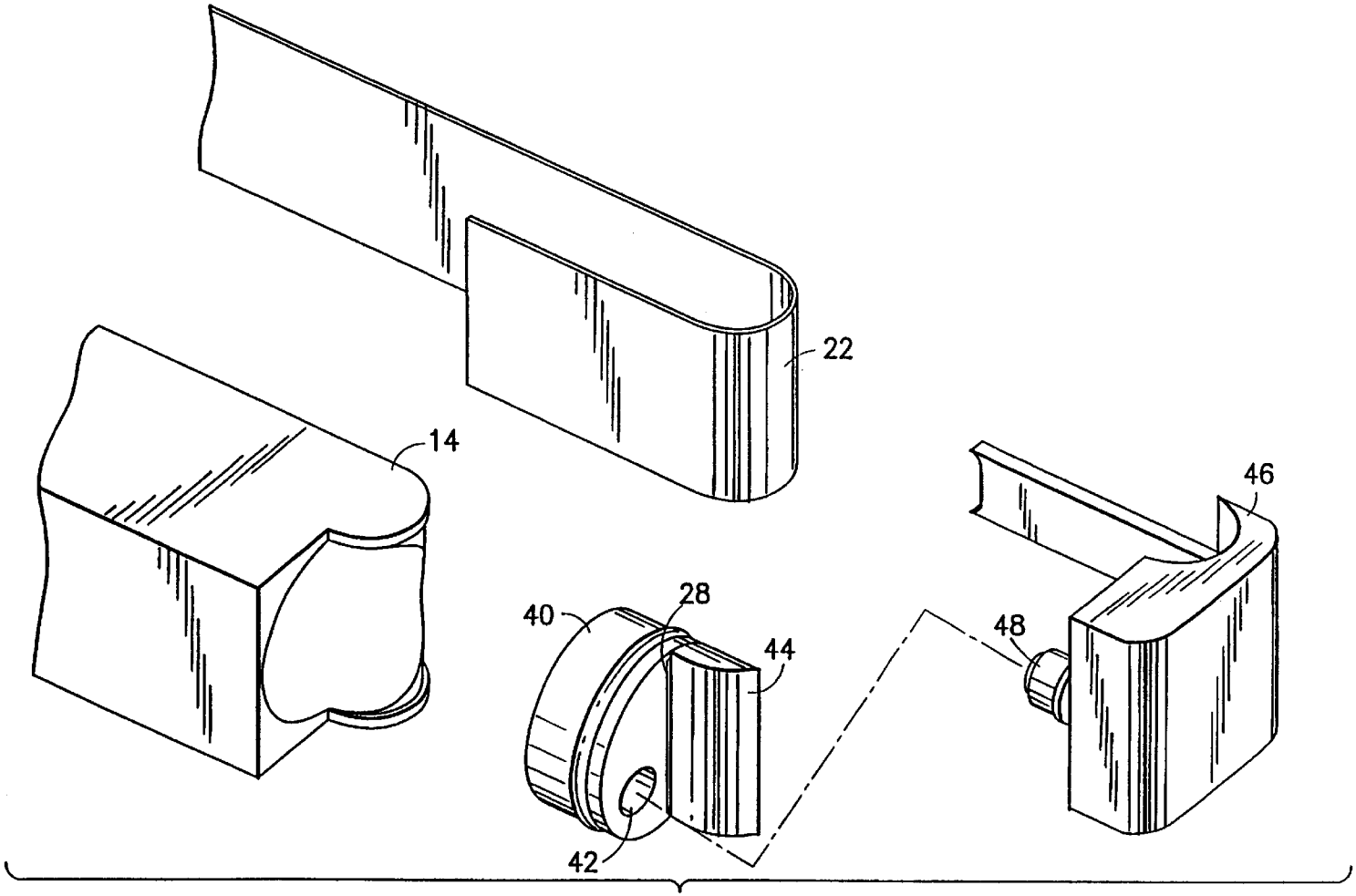
FIG. 5 is an exploded perspective view of the bottom, fill end of the cosmetics container of FIG. 2.

With particular reference to FIG. 5, the lower structure of the container 10 is illustrated. The reservoir 14 is provided with an end plug 40 having a fill port 42 and a curved surface 44 partially supporting and guiding the drive belt 22. A slot 28 admits the drive belt 22 for driving the slide base 36 and applicator brush 18. A bottom cap 46 includes a plug 48 for the fill port 42 and additional guide geometry for the drive belt 22.

The drive belt can also be provided in the form of a thinner drive shaft extending from a wider cover portion 23 providing a cover and seal over the exit passage 24 of the container.

Although the cosmetics container 10 has been described in connection with mascara cosmetics, the invention is fully intended to apply to containers of similar concept and structure adapted for use with lip gloss, concealer, eye shadow and other liquid, semi-liquid and pasty cosmetics products that are applied with a brush, foam pad, flocked member or other suitable applicator.

With reference to FIGS. 6–26, another cosmetics container 50 according to the invention herein is illustrated. The cosmetics container 50 is particularly well adapted for applying mascara, although, like container 10 described above, it is adaptable to other cosmetics upon appropriate selection of an applicator.

The cosmetics container 50 generally comprises a body 52 itself having an outer body 54 defining a passage 60 from the body 52 at the upper end of the container 50 and an inner body 56 defining a reservoir 58. The cosmetics container 50 further generally comprises a wiper 62 at the upper end of the body 52, and a cosmetics applicator 64 including a brush 66. The brush 66 is a twisted wire mascara brush, but other applicators may also be used. Drive means 70 including slidable knob 72 are operable on the exterior of the body for propelling the applicator through the wiper 62 and passage 60 to a use position as shown in FIG. 8, and for retracting the applicator into the reservoir as shown in FIG. 7. A cover 74 is connected with the drive means 70, for sealing the passage 60 when the applicator 64 is in its retracted position. The cosmetics container 50 also comprises an umbrella pump 76 which positions and stirs mascara 80 within the reservoir 58 as best seen in FIGS. 21–26 and more fully discussed below.

Figure 9:
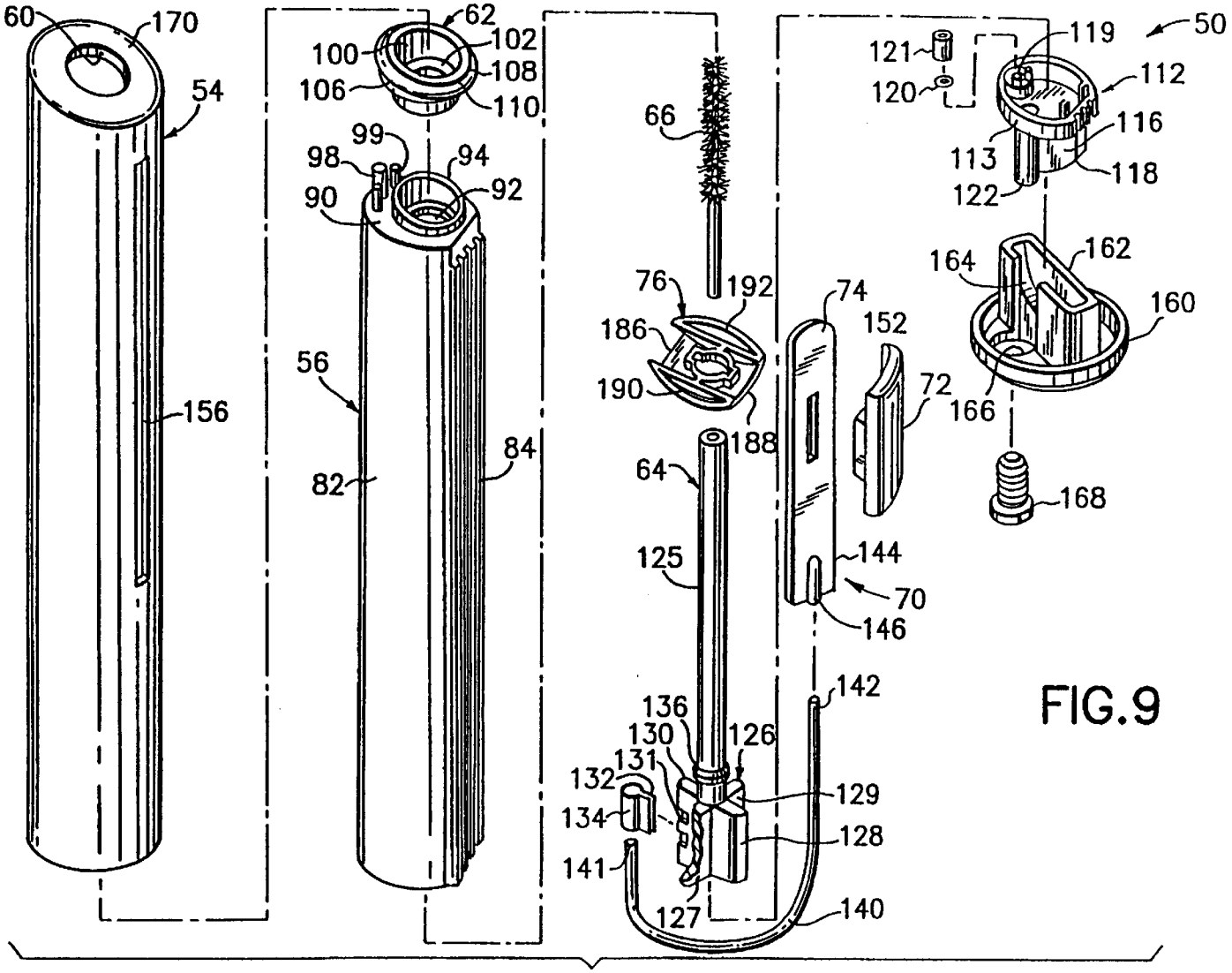
FIG. 9 is an exploded perspective view of the cosmetics container of FIG. 6.
Figure 16:
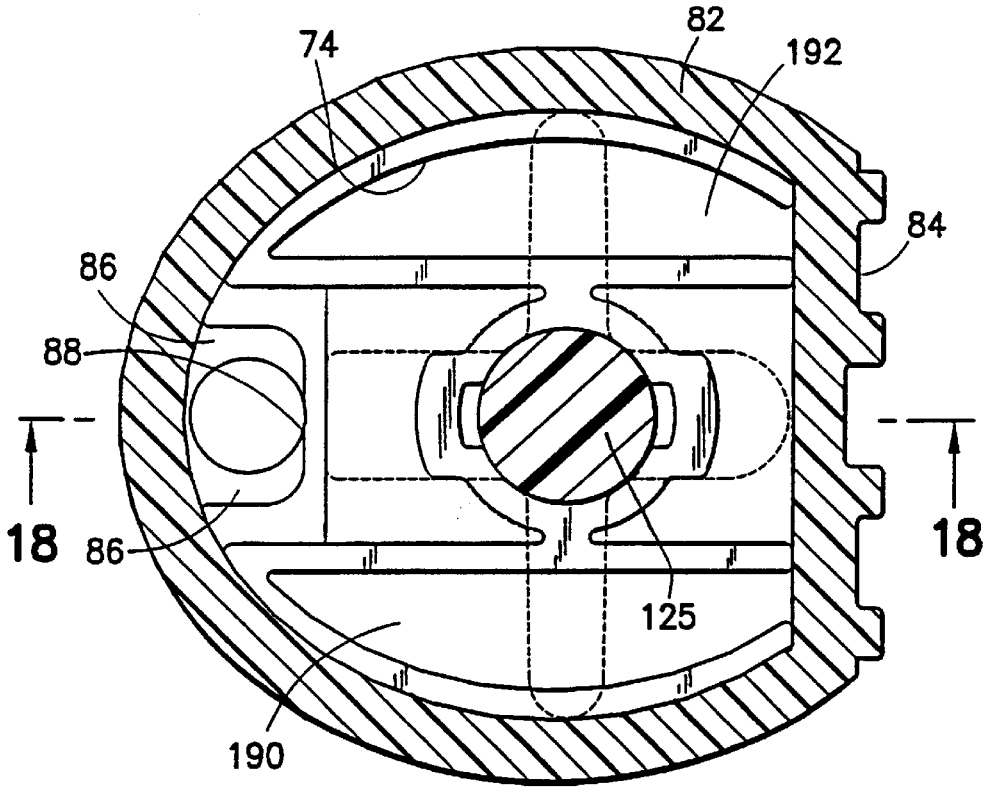
FIG. 16 is a partial sectional view of the cosmetics container of FIG. 6, taken along the lines 16—16 of FIG. 7.

The various parts of the cosmetics container 50 are shown in FIG. 9, arranged to in part illustrate their assembly and cooperation. The inner body 56 is a generally elongated tube having a continuous side wall 82, various portions of the side wall being shaped to cooperate with other elements. Thus, the side wall 82 has a flat ribbed front surface 84, which cooperates with the drive means 70 as more fully discussed below. The inner body 56 is open at both ends, and its side wall 82 partially defines the reservoir 58. Across the inner body from the front surface 84, elongated ribs 86 define a guide path along the reservoir 58, and define a slot 88 therebetween as best seen in FIG. 16, also for cooperating with the drive means 70 as further discussed below.

Figure 10:
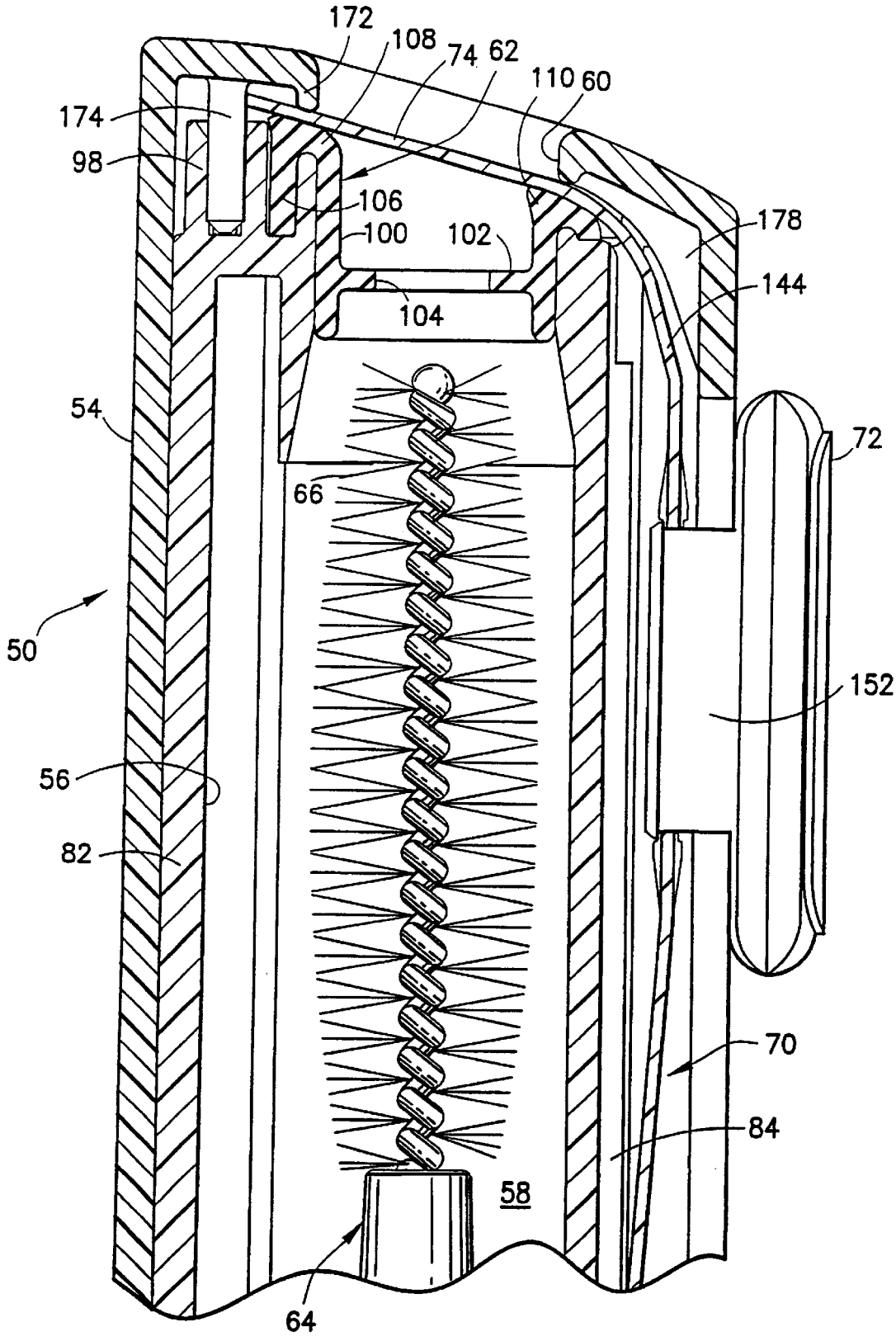
FIG. 10 is an enlarged fragmentary sectional view of the upper passage end of the cosmetics container of FIG. 6 with the applicator in its closed position.
Figure 11:
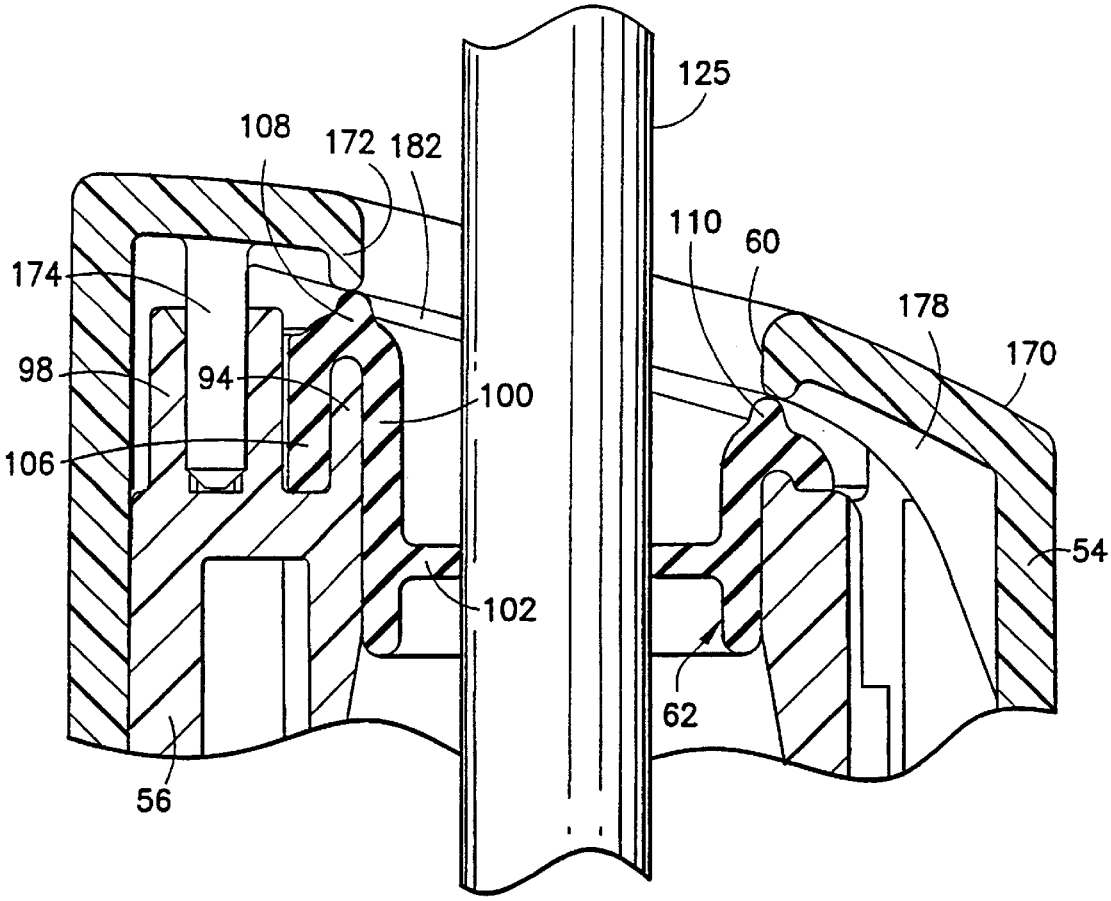
FIG. 11 is an enlarged fragmentary sectional view of the cosmetics container of FIG. 6, with the passage open and applicator in its extended, use position.
Figure 14:
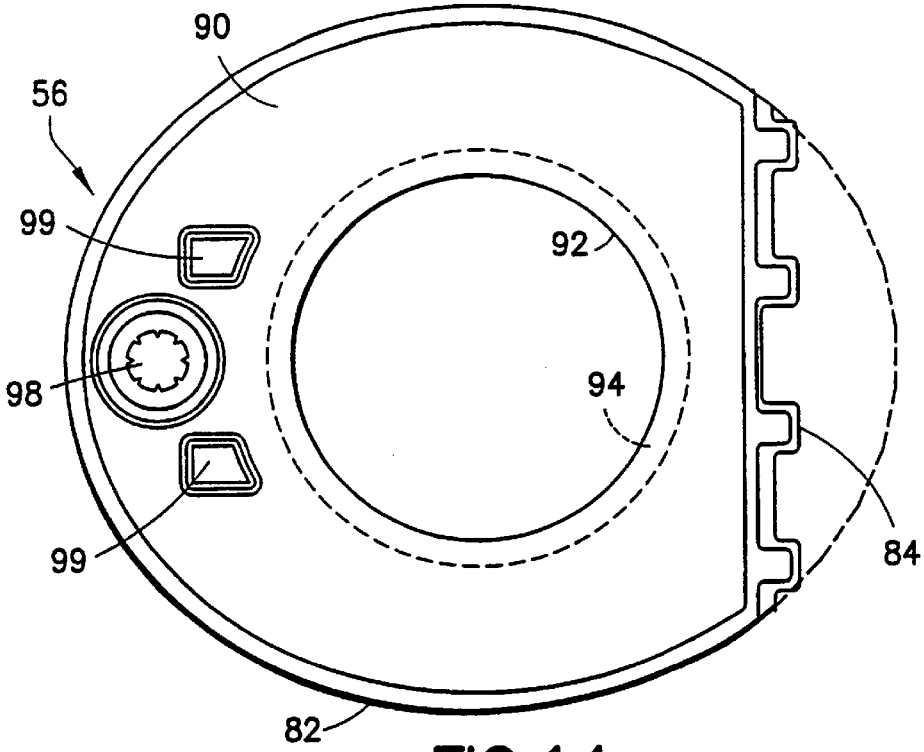
FIG. 14 is a sectional view of the inner body of the cosmetics container of FIG. 6 showing the inside of its top panel.
Figure 15:
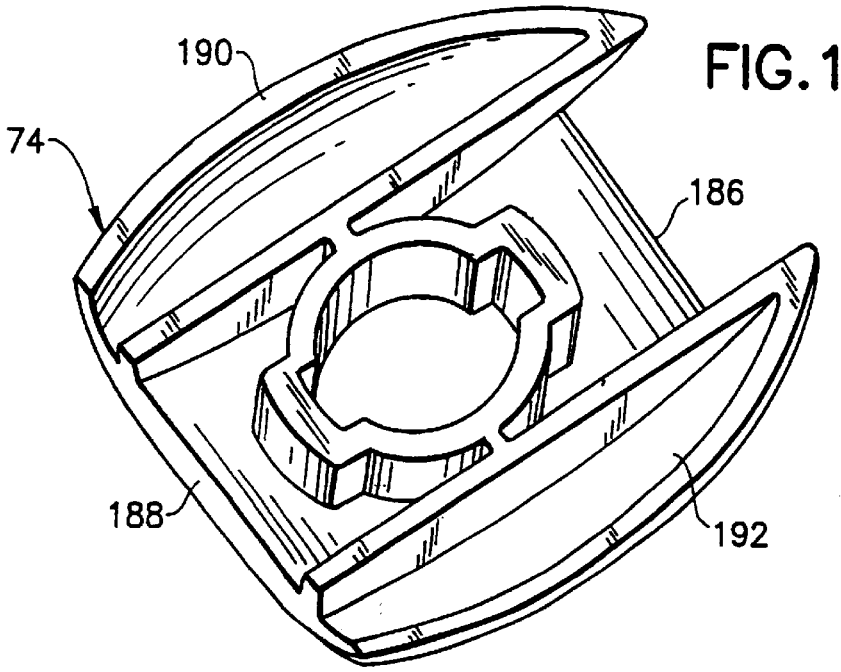
FIG. 15 is a perspective view of the umbrella pump of the cosmetics container of FIG. 6.

The inner body has a top panel 90, also seen from the underside in FIG. 14, defining an opening 92 for access to the reservoir 58. A wiper mounting flange 94 surrounds and defines the opening 92, and as best seen in FIGS. 10 and 11, the wiper mounting flange 94 has a flat distal end disposed on a bevel or angle with respect to the longitudinal axis of the inner body 56 and container 50. The top panel 90 also has a socket 98 upstanding therefrom, adjacent the high side of the wiper mounting flange 94, and two positioning lugs 99 are provided adjacent the socket 98.

The wiper 62 is fitted on the wiper mounting flange 94 at the top of the inner body 56. The wiper 62 has a cylindrical throat 100 extending into the opening 92 at the top of the inner body, and a wiper diaphragm 102 defines a wiper orifice 104 within the throat 100. A mounting collar 106 surrounds the upper end of the sleeve 100, connected to the throat by rim 108 at the upper end of the wiper, such that the wiper mounting flange 94 is embraced to hold the wiper 62 in position. The mounting collar 106 has a positioning lug extending radially therefrom but not seen, and it fits between the socket 98 and the positioning lugs 99, further orienting the wiper 62 on the inner body 56.

The wiper 62 further defines a sealing bead 110, which extends upwardly from wiper rim 108 and surrounds both the wiper throat 100 and the passage 60 to the reservoir 58 provided by the outer body 54. The wiper 62 is preferably fabricated of Buna-N synthetic rubber of Shore hardness in the range of approximately 40 to 90, and preferably about Shore 60.

Figure 12:
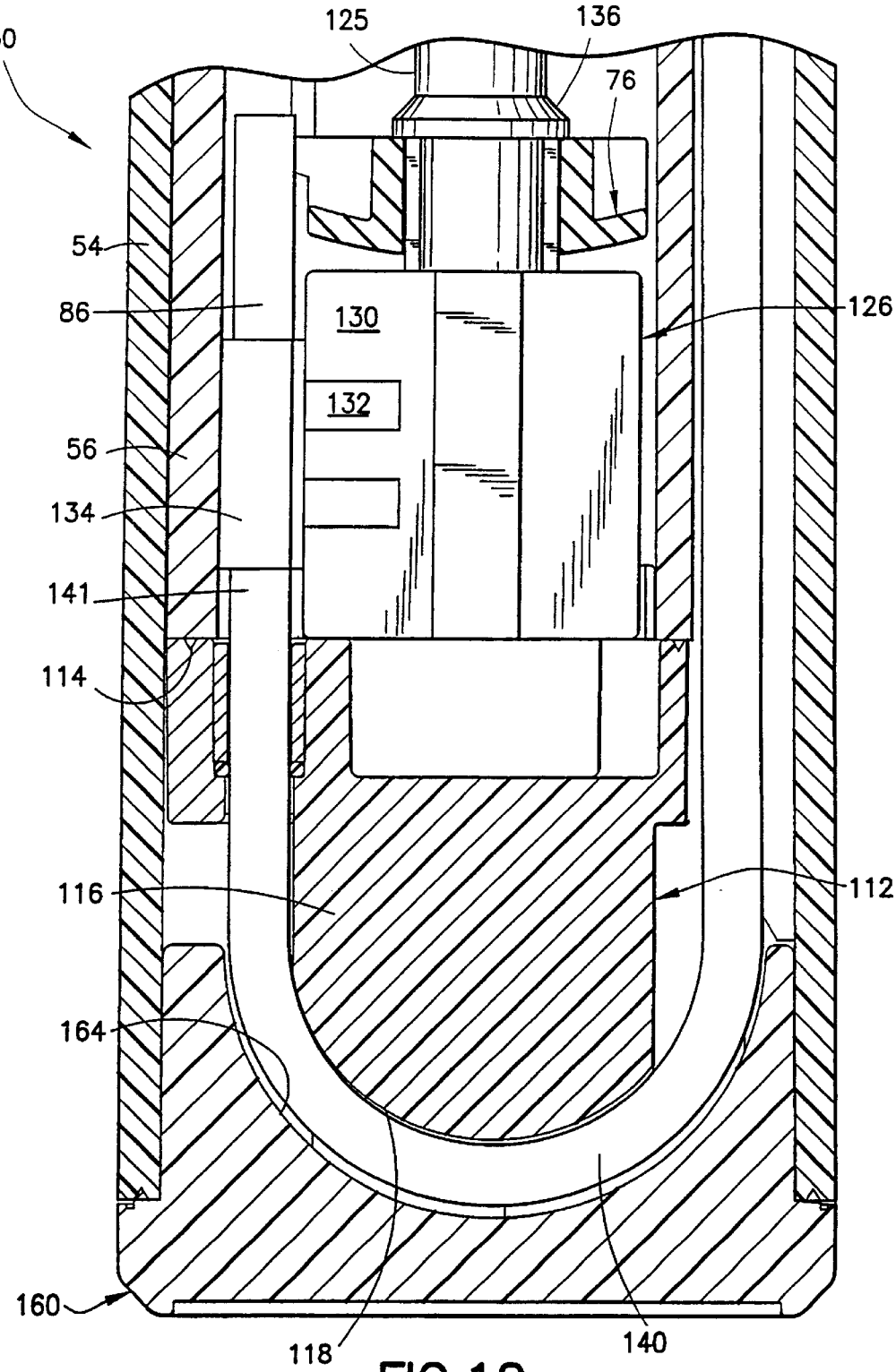
FIG. 12 is an enlarged fragmentary sectional view of the lower end of the cosmetics container of FIG. 6, with the applicator in its closed position.

The inner body 56 is provided with end plug 112. With reference to FIGS. 9 and 12, the end plug 112 has a peripheral sidewall 113 of the same size and shape as the lower end of inner body 56, including a ribbed front surface 114 such that it may be positioned adjacent the lower end of the inner body 56 and sonic welded thereto, as seen at 114 of FIG. 12.

The end plug 112 has a depending flange 116 defining a generally semi-circular curved lower surface 118, which in part defines a guide path for the drive means 70, as further discussed below. The end plug 112 defines an opening 119 adjacent the flange 116, also providing a portion of a guide path, and the opening has an O-seal 120 positioned therein and a keeper sleeve 121 positioned above the O-seal 120 for holding the O-seal 120 in position. The end plug 112 also defines a fill tube 122 opening into the reservoir 58.

The cosmetics container 50 further comprises the cosmetics applicator 64 and the applicator has a mascara brush 66 mounted on the distal end of the an applicator rod 125. The applicator rod extends from a slide member 126 generally comprising four radially extending fins 127–130. Flange 130 is split along line 131 and is formed with alternating teeth, for receiving and holding tab 132 of a drive rod connector 134. A radial flange 136 extends from the rod 125, spaced upwardly from the flanges 127–130.

It will be appreciated that the fins 27–130 are sized to guide the applicator 64 in reciprocal movement within the reservoir 58 defined by the inner body 56. The fin 130 is positioned adjacent the slot 88 defined between ribs 86, in which drive rod connector 134 i s received and guided.

The drive means 70 of the mascara container 50 include a flexible drive belt cable 140 having its first end 141 secured in t he connector 134. The drive belt cable 140 passes through the O-ring 120 and keeper sleeve 121 in the end plug 112, and the drive belt cable is also supported and guided within the reservoir 58 by the ribs 86, with tab 131 of connector 134 extending through slot 88 between ribs 86 to engage fin 130 of the applicator 64. The drive belt cable 140 is also deployed about the curved bottom surface 118 of flange 116 depending from the end plug 112, and the cable is further directed along the flat ribbed front surface 84 of the inner body 56, the cable also being guided between ribs. The second end 142 of the drive belt cable 140 is connected with the lower end of a drive belt cover strip 144. A socket 146 is provided thereon for receiving end 142 of the drive belt cable 140.

The drive belt cover strip has cover 74 at its distal end and defines an elongated opening 149 between its ends. The opening 149 mounts the knob 72 via a mounting stem 152 adapted to snap fit through the opening 149.

The outer body 54 of the cosmetics container 10 is also elongated and fits over the inner body 56. The outer body confines the drive belt cable 140, drive belt cover strip 144 and cover 74 adjacent the flat front surface 84 of the inner body, for guiding the cover drive belt cover strip and drive belt cable 140 generally along the front of the container. The outer body 54 defines a slot 156 which receives the stem 152, so that the drive knob 72 is positioned on the exterior of the outer body 52 and is connected with the drive belt cover strip 144 by means of the stem 152 extending through the slot 156. Thus, the knob 72 is connected to drive both the applicator 64 and cover 74.

A bottom cap 160 fits onto the lower end of the outer body 54, and has an upstanding guide sleeve 162 with a curved surface 164. The guide sleeve 162 receives the flange 116 of the end plug 112, and the surfaces 118 and 164 define a curved guide path for the drive belt cable 140 at the lower end of the container, transitioning it from vertical movement along the front surface of the of the cosmetics container in a U-turn to vertical movement along the opposite side of the cosmetics container between ribs 86. The bottom cap 160 also defines an opening 166 accommodating the fill tube 122, and a fill plug 168 is provided for sealing the fill tube after the container has been filled with mascara.

Figure 13:
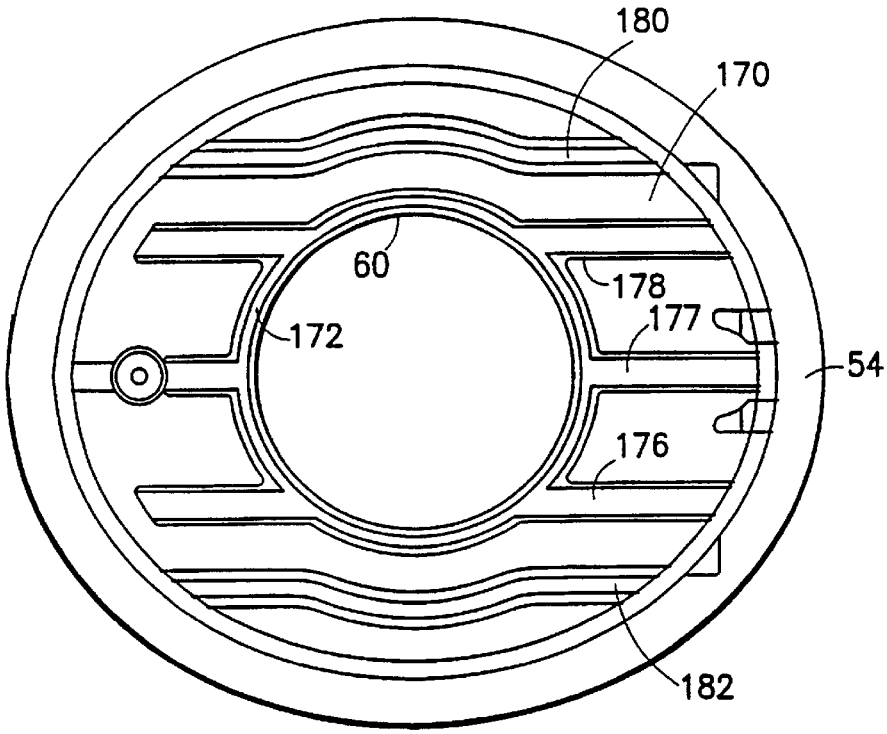
FIG. 13 is a sectional view of the outer body of the cosmetics container of FIG. 6, showing the inside of its end panel.

With reference to FIGS. 10, 11 and 13, the outer body 54 has an upper end panel 170 defining the passage 60 from the cosmetics container 50, and the end panel 170 includes a depending flange 172 at the peripheral edge of the passage 60. With reference to FIG. 11, the flange 172 is juxtaposed the sealing bead 110 of the wiper 62 when the passage 60 is uncovered. A mounting post 174 depends from the end panel 170 and is received in the socket 98 of the inner body 56, the post 174 providing the desired spacing between the depending flange 172 and wiper 62 with its sealing bead 110.

When the knob 72 is manipulated to its uppermost position in slot 156, the cover 74 of the drive belt cover strip 144 is deployed between the depending flange 172 of end panel 170 and the sealing bead 110 of the wiper, which is resilient to accommodate the cover 74, as best seen in FIG. 10. This closes and tightly seals the passage 60, closing off the reservoir 58 against leakage of mascara or other cosmetics, and further sealing the mascara or other cosmetics against drying by exposure to the atmosphere.

As best seen in FIG. 11 and 13, the underside of the top panel 170 defines guide flanges, the inner guide flanges 176, 177 and 178 providing a curved transition from the side wall of the outer body to the top panel of the outer body, for directing the cover 74 into the closed position illustrated in FIG. 10. The outside flanges 180 and 182 flank the cover 74, and thereby position it laterally with respect to the opening 60.

It will be appreciated that when the knob 72 is in its uppermost position, the cover 74 closes and seals the passage 60, and the drive belt cable 140 pulls the applicator 64 to its lowermost position in the reservoir. When the drive knob 72 is pulled downwardly along the outer body 56, the cover 74 is pulled away from the passage 60, at the same time the applicator 64 is propelled outwardly through the uncovered passage 60 from the reservoir 58.

The cosmetics container 50 also includes an umbrella pump 76, which is mounted on applicator rod 125 between slide 126 and its fins 127–130, and flange 136. Details of the umbrella pump 76 are illustrated in FIGS. 15–20. The umbrella pump 76 is shaped to generally conform to the inside of reservoir 58, including a notch 186 accommodating ribs 86, a straight edge 188 that lies adjacent at wall 84, and curved side pods 190, 192 that lie adjacent the curved wall portions of the reservoir and are cup shaped to spread and carry mascara or other cosmetics upwardly. The umbrella pump is also fabricated of flexible synthetic rubber material, preferably Buna-N.

Figure 17:
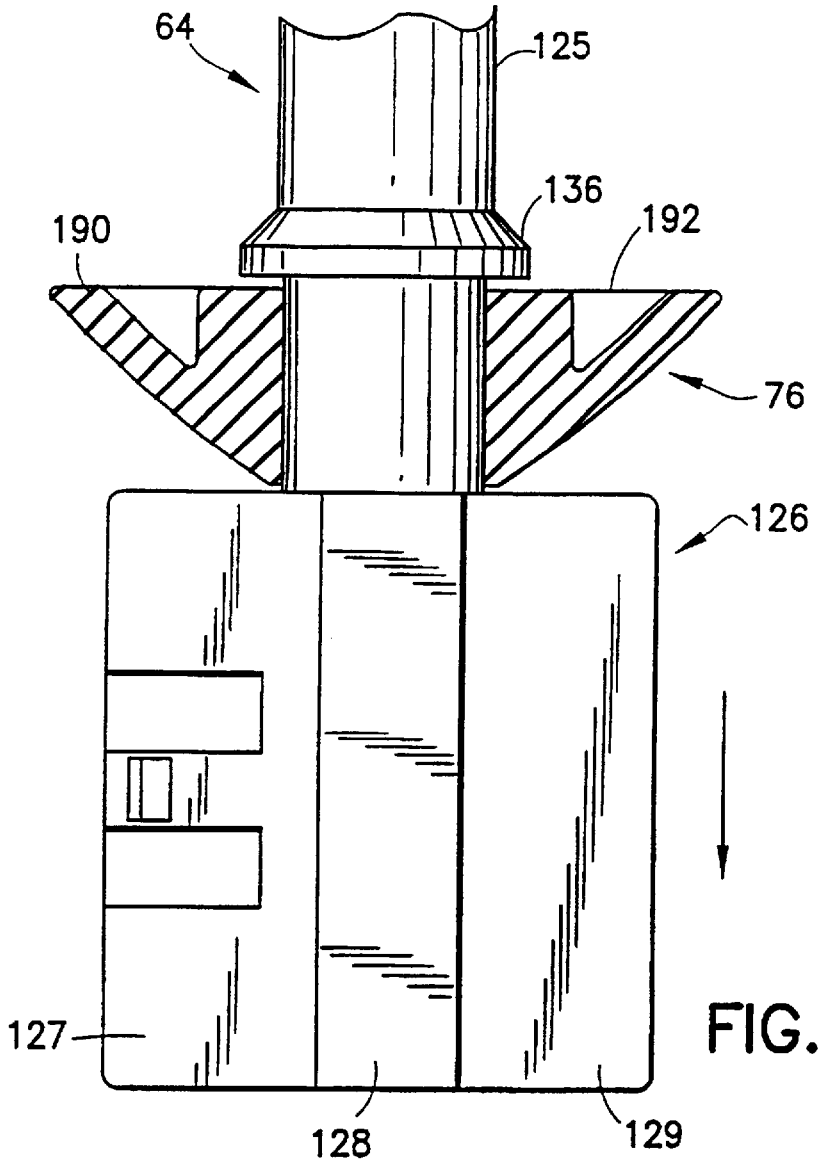
FIG. 17 is a side view of the umbrella pump in its orientation during downward movement of the applicator.
Figure 18:
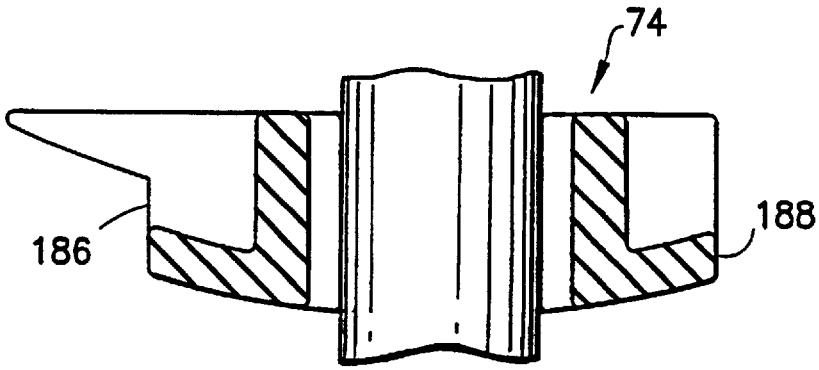
FIG. 18 is a sectional view of the umbrella pump taken along the lines 18—18 of FIG. 16.
Figure 20:
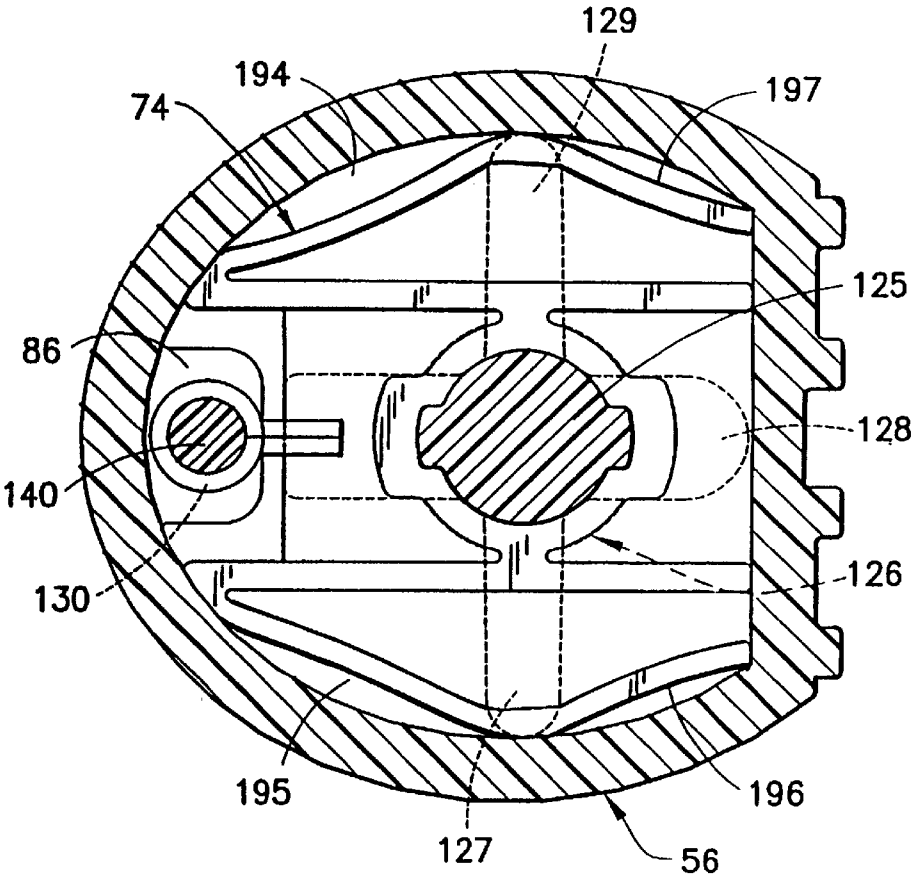
FIG. 20 is a sectional view of the umbrella pump and applicator, taken along the lines 20—20 of FIG. 19, and the adjacent inner body.

With reference to FIGS. 17 and 18, the umbrella pump 76 assumes the position shown, with the side pods 190 and 192 disposed generally upwardly, during a downward movement of the applicator 64, and is restrained on applicator rod 125 by the flange 136. The umbrella pump may also assume foregoing position on an upward stroke, without influence of cosmetics, or when the cosmetics are not viscous and is not placing significant force on the umbrella pump 76.

Figure 19:
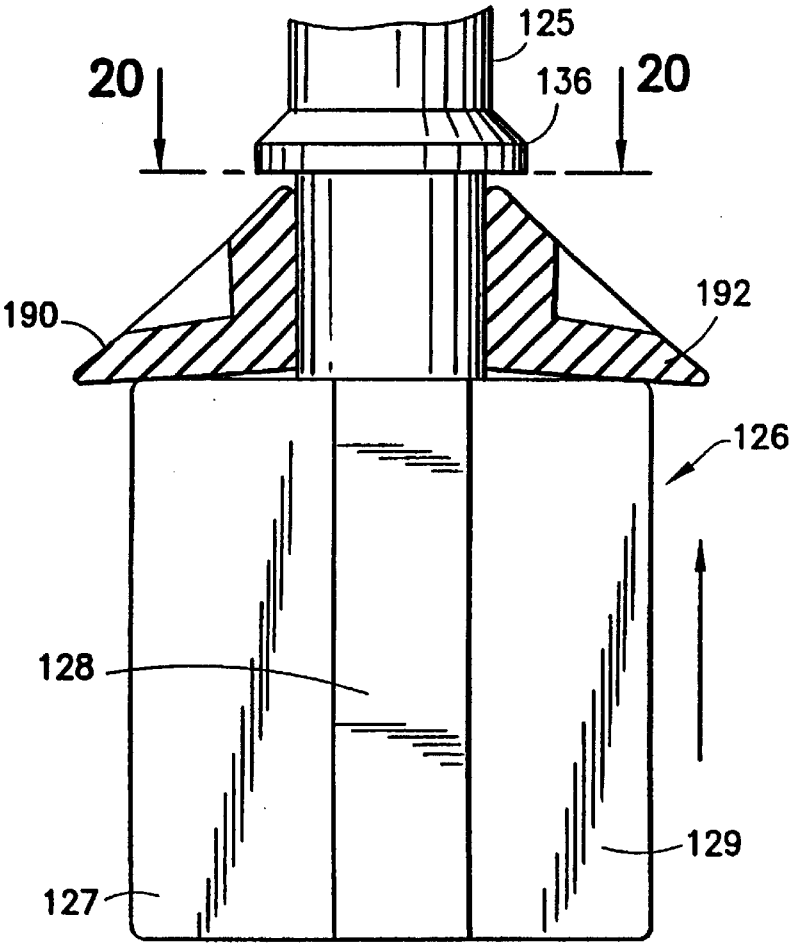
FIG. 19 is a side view of the umbrella pump and a portion of the applicator with the umbrella pump in its orientation during upward movement of the applicator.

With reference to FIG. 19, the umbrella is shown as it usually appears in an upward stroke of the applicator 64. The side pods 190 and 192 rub against the side walls of the reservoir, which tends to turn the umbrella "inside out" into the flattened position supported on the radial fins 127–130. The pods 190, 192 are nevertheless deployed to carry mascara upwardly.

However, the mascara is viscous, and does resist being carried and therefor exerts pressure with respect to the umbrella pump, at which point the umbrella pump sags inwardly from the walls of the reservoir, permitting mascara to leak past it. In the downward stroke position shown in FIG. 17, the umbrella pump merely bends inwardly toward the applicator rod 25, permitting mascara to bleed by it. In the upward stroke shown in FIGS. 19 and 20, the umbrella pump 76 is supported on the fins 127–130, but sags downwardly and inwardly between the fins as illustrated at 194-197. This permits mascara to bleed past the umbrella pump 76 on the upward stroke of the applicator 64.

The operation of the cosmetics container 50, and of the umbrella pump 76 in particular, is illustrated in FIGS. 21–26. For clarity, only the inner body 56, wiper 62, applicator 64 and umbrella pump 76 are illustrated in FIGS. 21–26, it being understood that the drive means 70 extends and retracts the applicator 64 in the manner discussed above. The end cap 112 is shown schematically as a bottom closure of the reservoir 58, also for clarity and ease of illustration.

In FIGS. 21–26, the reservoir 58 has been filled with an appropriate volume of mascara which may comprise approximately one-third to one-half of the volume. Filling is accomplished by extending a small conduit through the fill tube 122 and flowing the mascara into the reservoir. The fill conduit may easily extend past the umbrella pump 76, due to its flexibility. After filling, the fill plug 168 closes off the fill tube 122.

Figure 21:
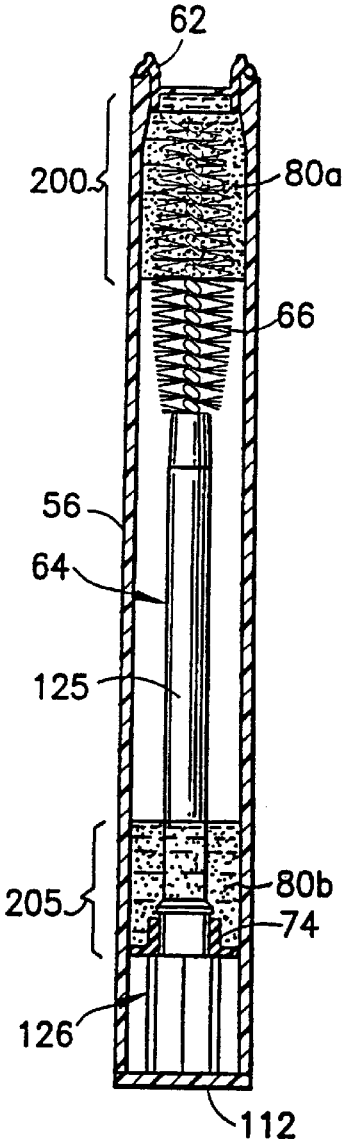
FIG. 21 is a schematic sectional view of the cosmetics container of FIG. 6 having cosmetics loaded therein, with the applicator in its retracted position.

With reference to FIG. 21, the applicator 64 is illustrated in its lower or retracted position. The distribution of the mascara 80 within the reservoir 58 illustrated in the drawing is achieved after several operating cycles of the applicator between its retracted and extended use position. It will be understood that the mascara 80 is not positioned within the reservoir in any particular manner by the filling process, and as will become more clear, the umbrella pump 76 operates to achieve the desired deployment.

When the applicator 64 is in its retracted position, the mascara 80 is substantially divided into a first portion 80*a* in a loading space 200 at the upper end of the inner body 56, adjacent the wiper 62. The loading space 200 surrounds at least a substantial portion of the mascara brush 66. The tip 67 of the mascara brush is preferably positioned closely adjacent the wiper diaphragm 102 so as to partially block the wiper orifice 104. When the mascara or other cosmetics is relatively viscous, this will substantially retain the mascara in the reservoir 58 between uses of the cosmetics container 50. An additional portion 80*b* of the mascara 80 is located in a pump space 205 at the lower end of the inner body 56, above the umbrella pump 76. Some of the mascara is below the umbrella pump 76, adjacent the fins 127-130.

Figure 22:
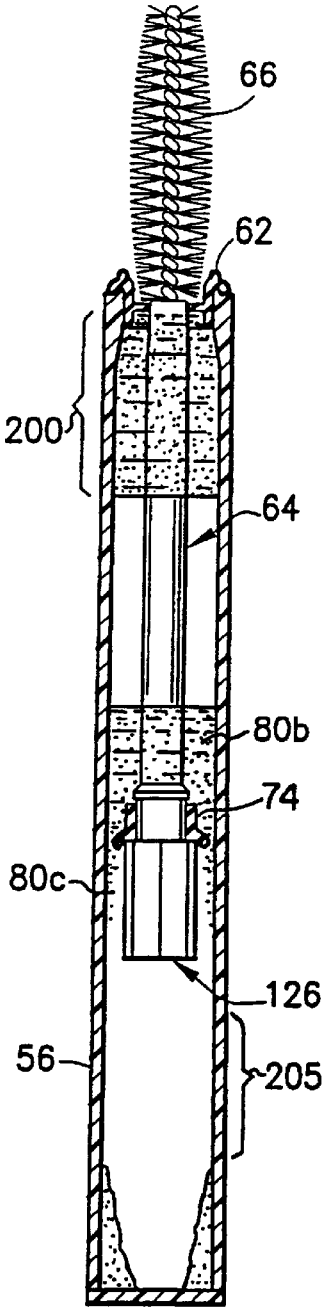
FIG. 22 is a schematic sectional view of the cosmetics container of FIG. 6 having cosmetics loaded therein, with the applicator being propelled outwardly.

With reference to FIG. 22, the applicator is shown partially extended through the wiper 62, exposing the mascara brush 66. It will be appreciated that the upper portion of the mascara brush 66 was positioned in cosmetics 80*a* in the loading space 200 and the remainder of the mascara brush 66 passes through the loading space in translation from the position shown in FIG. 21 to the position shown in FIG. 22, whereby the mascara brush 66 is appropriately loaded with mascara for application to eyelashes. The wiper adjusts the amount of mascara on the extended brush, in accordance with usual mascara container practice. However, the wiper operates very effectively because the brush is uniformly loaded before being extended. With continued reference to FIG. 22, the umbrella pump 76 carries a substantial part of the mascara 80*b* upwardly from the pump space 205. Because the umbrella pump 76 does not perfectly seal with the sides of the reservoir 58 and because it is flexible, a portion of the mascara 80*c* bleeds past and trails behind the umbrella pump 76 along the wall of the reservoir 58.

Figure 23:
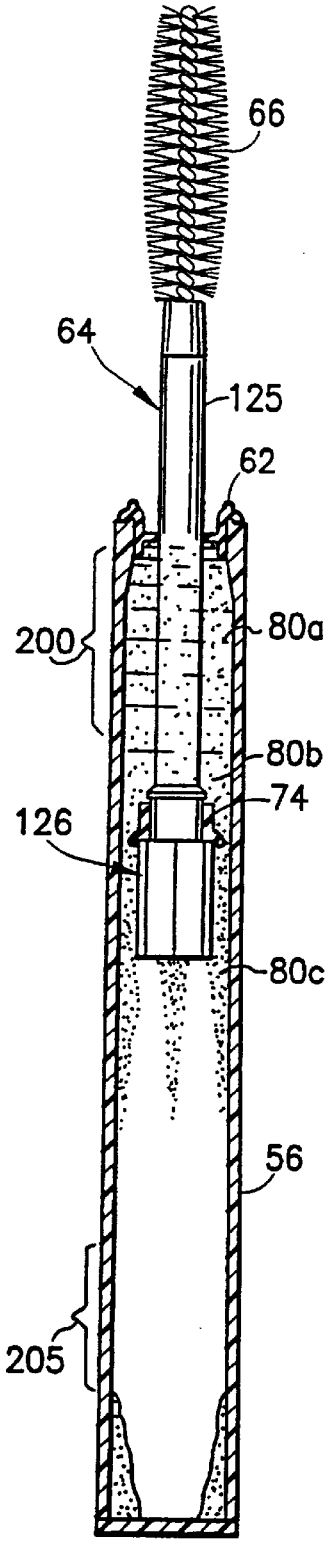
FIG. 23 is a schematic sectional view of the cosmetics container of FIG. 6 having cosmetics loaded therein, with the applicator propelled outwardly by an additional increment with respect to the position shown in FIG. 22.

With reference to FIG. 23, the applicator 65 is approaching its outermost extended position. Inside the reservoir 58, the mascara 80*b* carried upwardly by the umbrella pump 76 joins the mascara 80*a* in the loading space 200. Because the applicator rod 125 is in sealing engagement with the wiper diaphragm 102, the loading space 200 is essentially filled and the excess volume of mascara leaks by the flexible umbrella pump 76 and is deposited on the inside walls of the reservoir, as indicated at 80*c*. The umbrella pump assumes the position shown in FIG. 20 to permit the excess mascara to bleed past the edges of the umbrella pump 76. The merger of the cosmetics 80*b* being carried upwardly with the mascara 80*a* already in the loading zone mixes the two portions of mascara 80 and stirs and agitates the mascara 80, which is helpful in keeping the mascara fresh for use.

Figure 24:
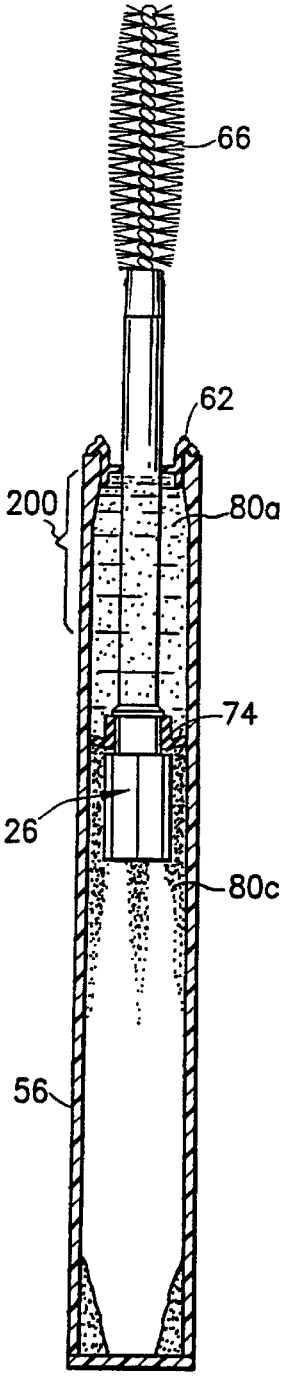
FIG. 24 is a schematic sectional view of the cosmetics container of FIG. 6 loaded with cosmetics, with the applicator extended to its use position.

With reference to FIG. 24, the applicator 66 is shown at the initial stage of retraction from the furthest extended position. Thus, the umbrella pump 76 reverts to the position shown in FIG. 17, in preparation for collecting the mascara 80*c* left on the side walls of the reservoir during its downward stroke.

Figure 25:
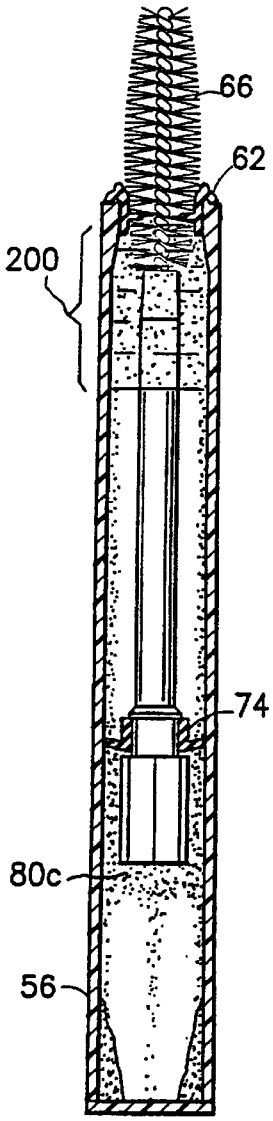
FIG. 25 is a schematic sectional view of cosmetics container of FIG. 6 loaded with cosmetics, with the applicator partially retracted from its use position.

With reference to FIG. 25, the applicator is shown partly retracted, with the brush re-entering the reservoir through the wiper orifice. The umbrella pump 76 is correspondingly retracted into the reservoir 25, leaving a portion of mascara 80*a* in the loading space 200. The umbrella pump 76 has substantially wiped the mascara 80*c* from the side walls of the reservoir between the loading space 200 and the umbrella pump 76, collecting this mascara below the umbrella pump and surrounding the slide 126.

Figure 26:
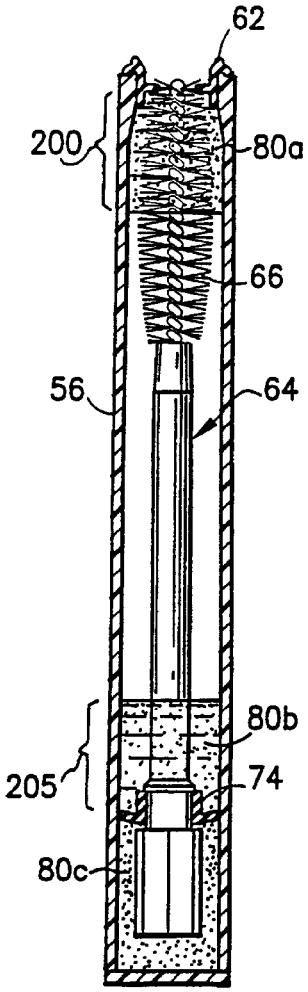
FIG. 26 is a schematic sectional view of the cosmetics container of FIG. 6 loaded with cosmetics, with the applicator further retracted from its use position with respect to the position shown in FIG. 25.

As the applicator 64 approaches its lower most position shown in FIG. 26, there is insufficient space surrounding the slide 126 to accommodate the mascara wiped from the walls, and the umbrella pump flexes to permit the mascara to leak by and occupy the pump space 205, that mascara now being shown as the portion 80*b*. It will appreciated that there is substantial mixing and agitating of the mascara as it bleeds by the umbrella pump 76 to fill the pump space 205. At the upper end of the reservoir, the applicator brush 66 is re-immersed in the mascara 80*a* in the loading space 200. Of course, as discussed above, the cover 74 is deployed across the exit passage 60 when the applicator is retracted, sealing the mascara from leakage and drying between uses.

Of course, all of this positioning and mixing of mascara is occurring in normal use of the cosmetics container 50. The user merely slides the drive knob 72 downwardly with one hand, and is presented with an applicator properly loaded with mascara or other cosmetics, and may recharge the brush by additional one hand operation of the knob 150. When the knob is left up, the container is closed and sealed.

Accordingly, cosmetics containers admirably fulfilling the objects of the invention herein have been described. It will be appreciated by those skilled in the art the mascara containers described are preferred embodiments and that various changes may be made without departing from the spirit and the scope of the invention, which is limited only by the following claims.

What is claimed is:

1. A cosmetics container for one hand operation, comprising:

A) a body defining a reservoir therein for receiving cosmetics and further defining a passage providing access to the reservoir;

B) a wiper positioned at one end of the body and positioned adjacent the passage to the reservoir, the wiper defining an opening from the reservoir generally aligned with the passage;

C) a cosmetics applicator slidably supported within the reservoir for movement from a loading position in the reservoir to a use position with the applicator extended through the passage;

D) drive means mounted to the body, the drive means having a knob presented on the exterior of the body and adapted for one hand manipulation and a drive belt sealingly extending into the reservoir and connected with the applicator, wherein operation of the knob in a first direction propels the applicator through the passage to the use position and operation of the knob in a second direction retracts the applicator into the reservoir; and E) a cover mounted to the body and connected with the drive means for movement between a closed position sealing the passage and an open position exposing the passage, wherein operation of the knob in the first direction moves the cover to expose the passage prior to propelling the applicator therethrough, and operation of the knob in the second direction moves the cover to the closed position after retracting the applicator therethrough.

2. A cosmetics container as defined in claim 1, wherein the cover is slidingly mounted on the body for sliding movement between its open and closed positions.

3. A cosmetics container as defined in claim 2, wherein the wiper is resilient and seals to the cover in its closed position.

4. A cosmetics container as defined in claim 3, wherein the wiper includes a resilient rim adjacent the portion of the body defining the passage, and the cover slides between the body and the rim to engage and seal to the rim.

5. A cosmetics container as defined in claim 4, wherein the wiper is deformed into sealing engagement with the cover.

6. A cosmetics container as defined in claim 4, wherein the wiper has a sealing bead upstanding from the rim, and the sealing bead deformably engages against the cover.

7. A cosmetics container as defined in claim 1, wherein the body is elongated and defines the passage on an upper end thereof, and the cover has a flexible flat configuration to slide into its close position between the wiper and the portion of the body defining the passage.

8. A cosmetics container as defined in claim 1, wherein the knob, drive belt and cover are slidingly mounted to the body and are connected to slide together with respect to the body.

9. A cosmetics container as defined in claim 8, wherein the knob is presented on a side of the body with respect to an end of the body defining the passage, and the drive belt is guided in a U-shaped path so that the portion of the drive belt extending into the reservoir and cover move in opposite directions in relation to the passage end of the body.

10. A cosmetics container as defined in claim 1, wherein the body includes an inner body defining the reservoir and an outer body fitted generally over the inner body and defining the passage providing access to the reservoir.

11. A cosmetics container as defined in claim 10, wherein the wiper is mounted on the inner body and the cover when closed is positioned between the wiper body and the portion of the outer body defining and surrounding the passage.

12. A cosmetics container as defined in claim 10, wherein the drive belt is in part guided between the inner body and outer body.

13. A cosmetics container as defined in claim 10, wherein the drive belt includes a drive belt cable guided in a U-turn at the end of the body opposite the passage and sealingly extends into the reservoir where it is connected with the applicator, and a drive belt cover strip secured to the drive belt cable outside the reservoir and including the cover at a distal end thereof.

14. A cosmetics container as defined in claim 10, wherein the knob is presented on the exterior of the outer body and is secured to the drive belt by a stem passing through a slot in the outer body, the slot being elongated for slidingly operating the knob.

15. A cosmetics container as defined in claim 1 and further comprising an umbrella pump mounted to the applicator for reciprocal sliding movement in the reservoir with the applicator, the umbrella pump adapted to agitate cosmetics in the reservoir.

16. A cosmetics container as defined in claim 15, wherein the applicator includes a rod and umbrella seal is mounted to the rod.

17. A cosmetics container as defined in claim 16, where in the umbrella pump lifts cosmetics to a loading zone adjacent the wiper.

18. A cosmetics container as defined in claim 16, wherein the rod is mounted on a slide with radially extending fins that support the rod with respect to the walls of the reservoir, and the umbrella pump is mounted to the rod adjacent the radial fins.

19. A cosmetics container as defined in claim 18, wherein the umbrella pump is supported on the radial fins during upward movement of the applicator lifting cosmetics to the loading zone adjacent the wiper.

20. A cosmetics container as defined in claim 17, wherein the cosmetics container is filled with a volume of cosmetics exceeding the volume of the loading space, and the umbrella pump releases excess volume of the cosmetics along the reservoir walls after filling the loading space during upward movement of the applicator and umbrella pump.

21. A cosmetics container as defined in claim 20, wherein upon retracting the applicator into the reservoir, the umbrella pump wipes the excess cosmetics to a pump space at the lower end of the reservoir, the umbrella pump flexing to bleed cosmetics to a position above the umbrella pump in the pump space where it is positioned above the umbrella pump for lifting toward the loading space on the next upward movement of the applicator.

22. A cosmetics container as defined in claim 1, wherein the reservoir contains mascara.

23. A cosmetics container as defined in claim 1, wherein the applicator includes a mascara brush.

24. A cosmetic container comprising:

A) an elongated inner body including an end plug at its lower end, the elongated inner body and end plug defining a reservoir for receiving cosmetics and an opening at the upper end of the inner body;

B) a resilient wiper mounted to the upper end of the inner body and defining a wiper opening from the reservoir, said wiper having an upwardly extending peripheral rim surrounding the wiper opening;

C) an outer body fitted over the inner body and defining a passage providing access to and from the reservoir and wiper opening, the portion of the outer body surrounding and defining the passage positioned juxtaposed the rim of the flexible wiper;

D) an applicator slidably mounted in the reservoir for movement between a first mascara loading position within the reservoir and a second use position with the distal end of the applicator extending outwardly through the wiper and passage;

E) drive means for moving the applicator between its first and second positions, the drive means including a drive belt cable, one end of said drive belt cable being connected to the applicator and the other end of the drive belt cable being connected to one end of a drive belt cover strip, a cover at the other, distal end of the drive belt cover strip said drive belt cover strip being supported in a guide path between the inner body and outer body, and a knob secured to one of the drive belt cable or drive belt cover strip and extending through a slot in the outer body for manual manipulation in a sliding manner;

F) an end cap on the outer body, the end cap of the outer body and the end plug of the inner body together defining a U-turn guide path at the lower end of the container for directing the drive belt cable into the reservoir, and the end plug of the inner body sealingly passing the drive cable into the reservoir for connection therein to the applicator;

whereby sliding the knob upwardly simultaneously retracts the applicator from its extended use position and slides the cover to a sealing position between the wiper and the portion of the outer body defining the passage, and sliding the knob downwardly simultaneously withdraws the cover from its sealing position and propels the applicator from the reservoir.

25. A cosmetics container as defined in claim 24, and further comprising:

G) an umbrella pump fitted for sliding movement with the applicator in the reservoir, the umbrella pump being fabricated of flexible material for carrying cosmetics upwardly to a loading zone adjacent the wiper and permitting excess cosmetics to bleed past the umbrella pump when the loading zone is full, and for carrying said excess cosmetics downwardly and bleeding the cosmetics to a pump zone above the umbrella pump in preparation for the umbrella pump carrying cosmetics upwardly on the next extension of the applicator.

26. A cosmetics container as defined in claim 25, wherein the reservoir is partially filled with mascara and the distal end of the applicator is a mascara brush.

* * * * *